US006085703A

United States Patent [19]

Noguchi

[11] Patent Number: 6,085,703

[45] Date of Patent: Jul. 11, 2000

[54] STRATIFIED SCAVENGING TWO-CYCLE ENGINE

[75] Inventor: Masanori Noguchi, Higashimurayama, Japan

[73] Assignees: Komatsu Zenoah Co., Higashiyamato; Petroleum Energy Center, Tokyo, both of Japan

[21] Appl. No.: 09/284,401

[22] PCT Filed: Oct. 15, 1997

[86] PCT No.: PCT/JP97/03713

§ 371 Date: Apr. 13, 1999

§ 102(e) Date: Apr. 13, 1999

[87] PCT Pub. No.: WO98/17901

PCT Pub. Date: Apr. 30, 1998

[30] Foreign Application Priority Data

Oct. 17, 1996 [JP] Japan ..... 8-274986

[51] Int. Cl.[7] ..... F02B 33/04

[52] U.S. Cl. ..... 123/73 R; 123/65 V

[58] Field of Search ..... 123/73 R, 73 A, 123/65 V

[56] References Cited

U.S. PATENT DOCUMENTS 4,253,433 3/1981 Blair ..... 123/73 R 4,481,909 11/1984 Takada et al. ..... 123/73 R 4,820,213 4/1989 Holtermann et al. ..... 123/73 R 5,410,993 5/1995 Masuda et al. ..... 123/65 V

*Primary Examiner*—John Kwon

*Attorney, Agent, or Firm*—Sidley & Austin

[57] ABSTRACT

The present invention is a stratified scavenging two-cycle engine which has a more compact structure. The stratified scavenging two-cycle engine includes a scavenging flow passage (3) for connection between a cylinder chamber (4*a*) and a crank chamber (1*a*); and an air flow passage (2) connected to the scavenging flow passage (3), the scavenging flow passage (3) is continuously formed by a communication portion (30) extending from the crank chamber (1*a*) toward the cylinder chamber (4*a*) side; and a scavenging direction adjustment portion (31) extends from the communication portion (30) toward a cylinder inner surface (4*b*) side and opens at a scavenging port (3*a*) in the cylinder inner surface (4*b*). The air flow passage (2) extends into an area surrounded by the communication portion (30), the scavenging direction adjustment portion (31), and the cylinder inner surface (4*b*).

14 Claims, 4 Drawing Sheets

STRATIFIED SCAVENGING TWO-CYCLE ENGINE

TECHNICAL FIELD

The present invention relates to a stratified scavenging two-cycle engine which takes in a fluid mixture and air separately.

BACKGROUND ART

Conventionally, a stratified scavenging two-cycle having a fluid mixture flow passage (not shown) for supplying a fluid mixture is connected to a crankcase 1 and an air flow passage 2 for supplying air is connected to a scavenging flow passage 3, is known (as shown in FIGS. 3 and 4). The scavenging flow passage 3 is continuously formed by a communication portion 30 extending from a crank chamber 1*a* to a cylinder chamber 4*a,* and a scavenging direction adjustment portion 31 extends from the communication portion 30 toward a cylinder inner surface 4*b* side and opens at a scavenging port 3*a* to the cylinder inner surface 4*b*.

The communication portion 30 is provided with a check-valve 10 at an air port 2*a* at which the air flow passage 2 is opened. The check-valve 10 permits air flow to the scavenging flow passage 3 from the air flow passage 2, and blocks back-flow to the air flow passage 2 from the scavenging flow passage 3. The entire body of the scavenging flow passage 3 is formed at the crankcase 1 and a cylinder block 4. The air flow passage 2 is formed within an air supply block 20. The air supply block 20 is attached to the cylinder block 4 with bolts, for example.

Meanwhile, the crankcase 1 is provided with a crankshaft 5, and a piston 7 is coupled to the crankshaft 5 with a connecting rod 6 between them. The piston 7 is fitted in the cylinder inner surface 4*b* and freely moves along an axial direction of the cylinder inner surface 4*b*. Further, the cylinder block 4 is provided with a cylinder head 8, which is provided with an ignition plug 9.

The scavenging port 3*a* leading to the scavenging flow passage 3 and an exhaust port (not shown) for exhausting combustion gas are opened to the cylinder inner surface 4*b*.

In the stratified scavenging two-cycle engine configured as above, as the piston 7 ascends, the pressure inside the crank chamber 1*a* starts to drop, and the scavenging port 3*a* and the exhaust port are sequentially closed. As a result, the fluid mixture in the cylinder chamber 4*a* is compressed, and the fluid mixture supplied from the mixture flow passage is passed into the crank chamber 1*a*. In this situation, air also enters the crank chamber 1*a* through the scavenging flow passage 3 from the air flow passage 2.

When the piston 7 reaches an area in the vicinity an upper-most position, the fluid mixture in the cylinder chamber 4*a* is ignited by means of the ignition plug 9, and thereby the pressure inside the cylinder chamber 4*a* rises and the piston 7 is descended. When the piston 7 descends to a predetermined position, the exhaust port and the scavenging port 3*a* are sequentially opened. As a result of the exhaust port being opened, the combustion gas is exhausted from the exhaust port, thereby the pressure inside the cylinder chamber 4*a* abruptly drops. As a result of the scavenging port 3*a* being opened, the air accumulated in the scavenging flow passage 3 spurts into the cylinder chamber 4*a* from the scavenging port 3*a,* and the combustion gas staying in the cylinder chamber 4*a* is compulsorily discharged from the exhaust port by the air. Thereafter, the fluid mixture in the crank chamber 1*a* enters the cylinder chamber 4*a* through the scavenging flow passage 3 from the scavenging port 3*a*. Thus the scavenging operation is completed.

Again the piston 7 ascends, and the aforesaid cycle is repeated once more.

According to the stratified scavenging two-cycle engine configured as above, the inside of the cylinder chamber 4*a* can be scavenged first by air, and combustible gas can be prevented from being discharged as a result of the fluid mixture blowing through, therefore obtaining an advantage that the exhaust gas is cleaned.

In the aforesaid stratified scavenging two-cycle engine, however, the air supplying block 20 is fixed on the side surface of the cylinder block 4, therefore causing a disadvantage that the engine size becomes larger, compromising compactness.

SUMMARY OF THE INVENTION

The present invention is made to eliminate the aforesaid disadvantages, and its object is to provide a stratified scavenging two-cycle engine which is more compact in structure.

In order to attain the aforesaid object, a stratified scavenging two-cycle engine according to the present invention includes a scavenging flow passage for connection between a cylinder chamber and a crank chamber, and an air flow passage connected to the scavenging flow passage, and is characterized in that the scavenging flow passage is continuously formed by a communication portion extending from the crank chamber to the cylinder chamber, and a scavenging direction adjustment portion extending from the communication portion toward a cylinder inner surface and opened at a scavenging port to the cylinder inner surface, and in that the air flow passage extends into an area surrounded by the communication portion, the scavenging direction adjustment portion, and the cylinder inner surface.

According to the above configuration, on forming the scavenging flow passage, the communication portion and the scavenging direction adjustment portion become necessary by any means. Specifically, if the cylinder chamber and the crank chamber is disposed up and down, the communication portion has to be extended in a vertical direction, and the scavenging direction adjustment portion has to be formed to face the cylinder inner surface, for example, the scavenging direction adjustment portion is bent at a right angle relative to the communication portion. As a result, an area surrounded by the communication portion, the scavenging direction adjustment portion, and the cylinder inner surface becomes a dead space with heavy wall thickness. However, the air flow passage is provided in the dead space, therefore the size of the engine does not become large. Specifically, it is not necessary to provide the air supply block as shown in the prior art, therefore the engine can be more compact in construction.

Further, the aforesaid air flow passage may be connected to the scavenging flow passage through an air port, and the scavenging flow passage may be provided with a check-valve, so that the check-valve prevents back-flow to the air flow passage through the air port.

According to the aforesaid configuration, the scavenging flow passage is provided with a check-valve, therefore back-flow from the scavenging flow passage to the air flow passage can be prevented.

Furthermore, at least, a part of the communication portion, the scavenging direction adjustment portion, a part of the cylinder inner surface, and the air flow passage may be formed in a one-piece scavenging block, and the scavenging block may be attached to a cylinder block.

According to the aforesaid configuration, at least, a part of the communication portion, the scavenging direction adjustment portion, a part of the cylinder inner surface, and the air flow passage are formed in the scavenging block separate from the cylinder block, therefore the scavenging block can be manufactured by, for example, die-casting with simplicity. Specifically, even though it is difficult to form a cylinder block having the communication portion, the scavenging direction adjustment portion, the air flow passage, and the like by die-casting, the scavenging block having the communication portion, the scavenging direction adjustment portion, the air flow passage, and the like can be formed by die-casting with ease, since the scavenging block is separate from the cylinder block.

BEST MODE FOR CARRYING OUT THE INVENTION

Figure 3:
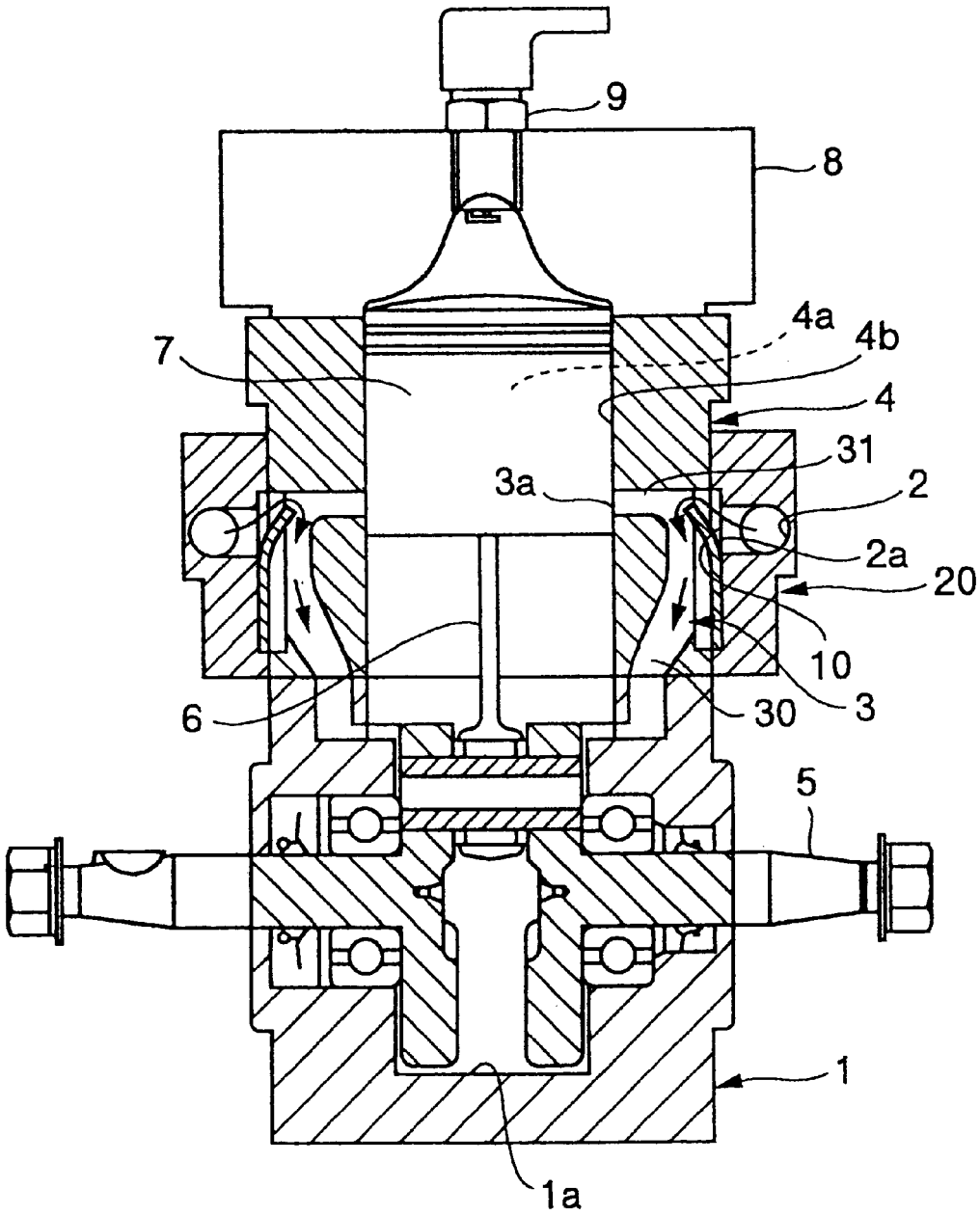
FIG.3 PRIOR ART
FIG. 3 is a sectional view of a conventional stratified scavenging two-cycle engine.
Figure 4:
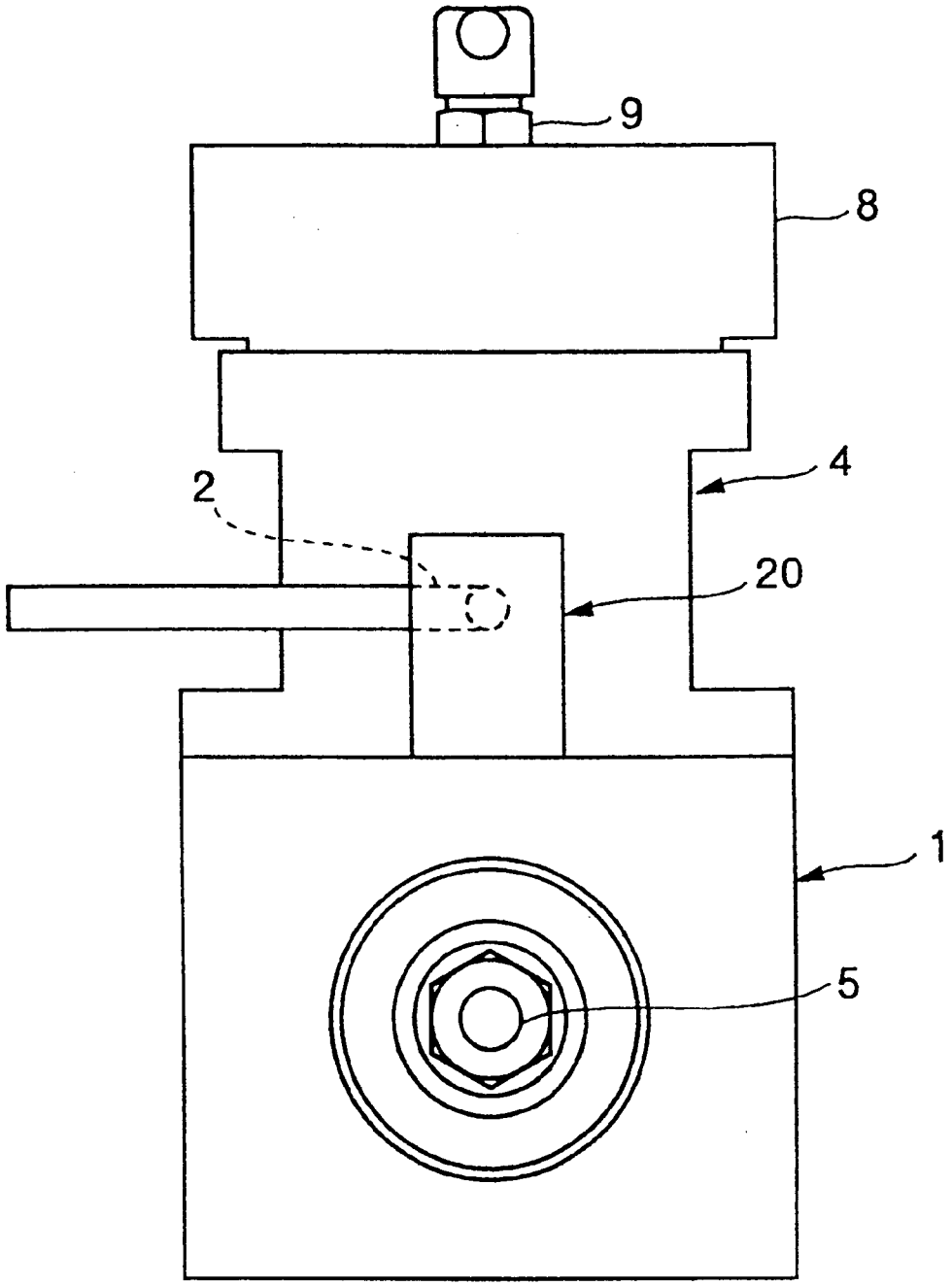
FIG.4 PRIOR ART
FIG. 4 is a side view of the stratified scavenging two-cycle engine of FIG. 3.

A preferred embodiment of the present invention will be explained with reference to FIGS. 1 and 2. It should be noted that the elements common to those in the prior art shown in FIGS. 3 and 4 are given the same symbols and numerals, and the explanation thereof will be simplified. A point in which the embodiment differs from the prior art is that an air flow passage 2 is provided in an area surrounded by a communication portion 30, a scavenging direction adjustment portion 31, and a cylinder inner surface 4*b*.

Figure 1:
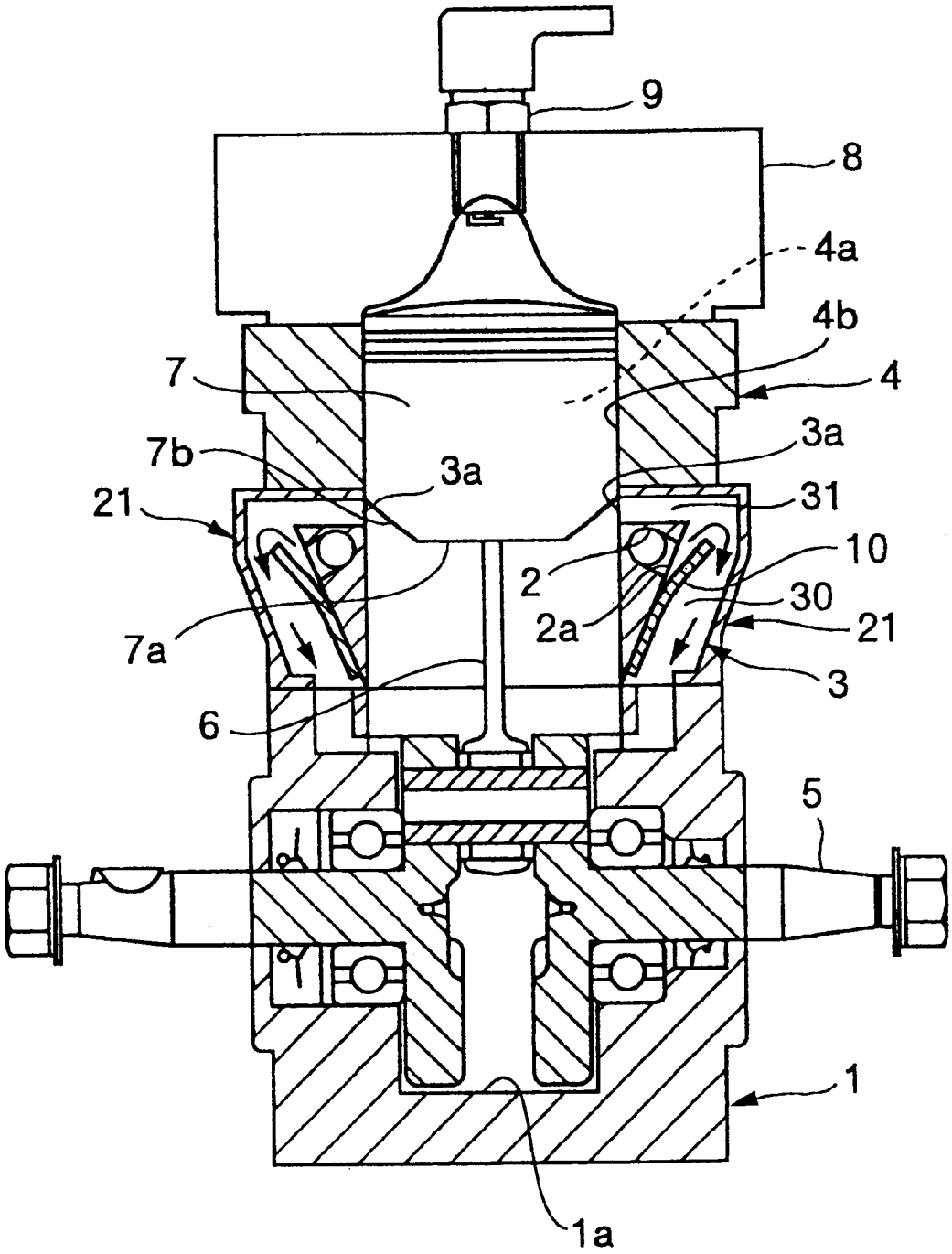
FIG. 1 is a sectional view of a stratified scavenging two-cycle engine shown as an embodiment of the present invention.
Figure 2:
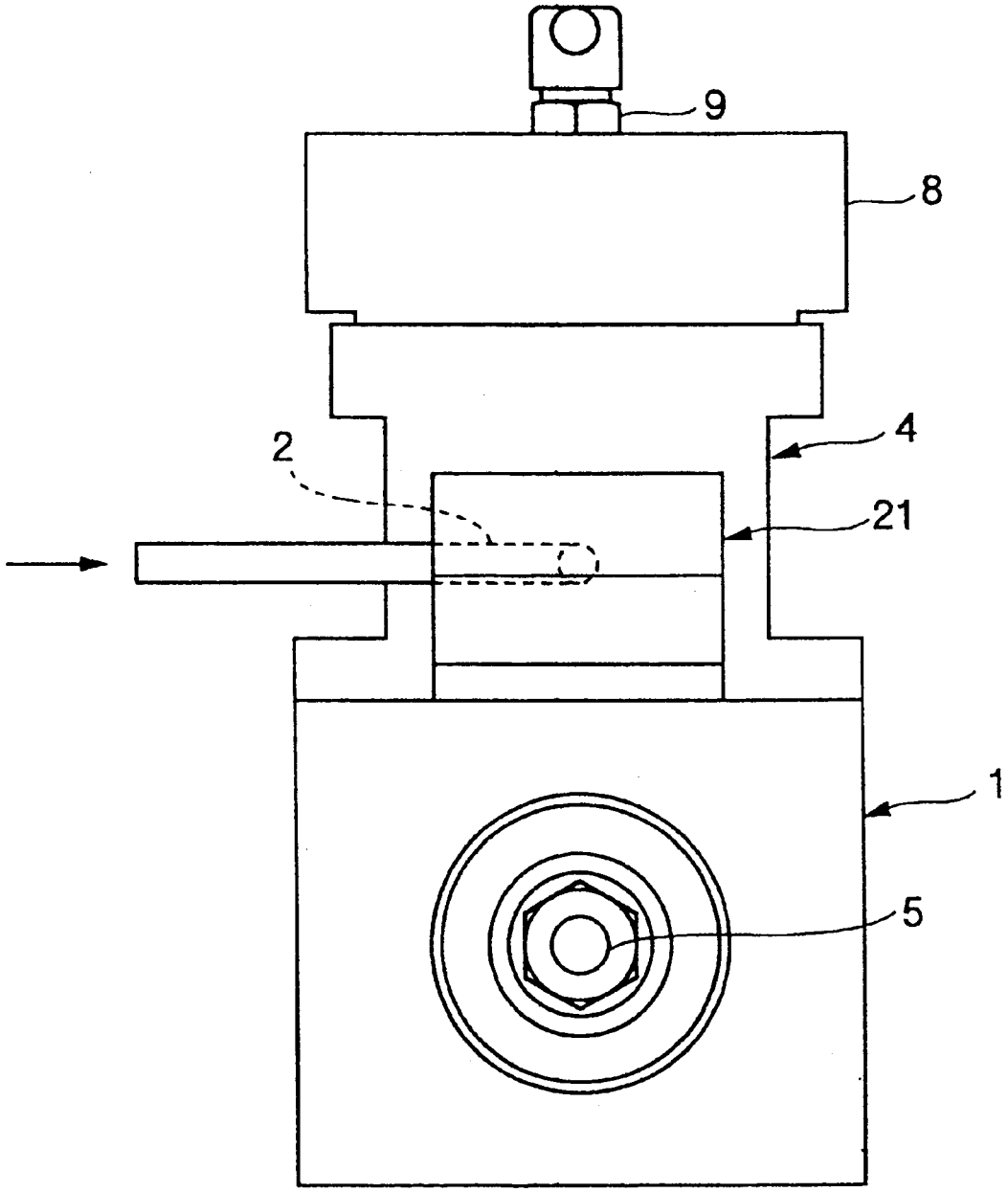
FIG. 2 is a side view of the stratified scavenging two-cycle engine of FIG. 1.

Specifically, as shown in FIGS. 1 and 2, the air flow passage 2 extensively exists in the area surrounded by the communication portion 30, the scavenging direction adjustment portion 31, and the cylinder inner surface 4*b*, and is opened at an air port 2*a* to the communication portion 30. The communication portion 30 is provided with a check-valve 10 which prevents the back-flow to the air flow passage 2 side through the air port 2*a*. The check-valve 10 is composed of a reed valve. One part of the communication portion 30, the scavenging direction adjustment portion 31, a part of the cylinder inner surface 4*b*, and the air flow passage 2 are formed in a one-piece scavenging block 21. The other part of the communication portion 30 is formed in a crankcase 1. The scavenging block 21 formed as above is fixed to a cylinder block 4 with bolts, for example.

A piston 7 has a notch 7*b* diagonally formed at a lower end 7*a* thereof in the embodiment as shown in FIG. 1. In a state in which the piston 7 is positioned at an upper-most position, the notch 7*b* is positioned where the upper end thereof is at a position higher than the upper edge of the scavenging port 3*a*. Specifically, the entire scavenging port 3*a* is opened through the notch 7*b* and connected to a crank chamber l*a* in a state in which the piston 7 is positioned at the upper-most position. Further, the notch 7*b* is provided so as to face the direction at 90 degrees relative to the direction in which the connection rod 6 swings. It goes without saying that the aforesaid notch 7*b* is adjusted to obtain optimum timing.

The embodiment shows an example having the notch 7*b* diagonally formed at the lower end 7*a* of the piston 7, but naturally, it may be suitable to use a piston of the type without forming the notch 7*b*.

In the stratified scavenging two-cycle engine configured as above, when the piston 7 ascends, the pressure inside the crank chamber 1*a* reduces, then a fluid mixture flows into the crank chamber 1*a* through a fluid mixture flow passage (not shown), and air flows from the air flow passage 2 into the crank chamber 1*a* through the scavenging flow passage 3. During the stroke for taking in the air, the scavenging port 3*a* communicates with the crank chamber 1*a* through the notch 7*b* of the piston 7. As a result, the air taken in the scavenging flow passage 3 flows into the crank chamber 1*a* through the scavenging port 3*a*. Accordingly, the entire body of the scavenging flow passage 3 is filled with air.

Next, when the piston 7 descends as a result of the ignition of the mixture, the scavenging port 3*a* is closed and the pressure inside the crank chamber 1*a* rises. When the piston 7 descends by a predetermined amount, for example, the exhaust port opens, and the combustion gas flows out of the exhaust port, whereby abruptly reducing the pressure inside the cylinder chamber 4*a* and opening the scavenging port 3*a*. Air flows from the scavenging port 3*a* into the cylinder chamber 4*a* first, and then the fluid mixture in the crank chamber 1*a* flows from the scavenging port 3*a* into the cylinder chamber 4*a* through the scavenging flow passage 3.

The entire body of the scavenging flow passage 3, including the scavenging port 3*a*, side is filled with air as described above, therefore at the time of starting scavenging, only air flows into the cylinder chamber 4*a* first to expel combustion gas from the exhaust port. Accordingly, it is also possible to prevent a fluid mixture from flowing through to the exhaust port and to make exhaust gas cleaner.

In addition, by means of the notch 7*b* formed at the piston 7, the scavenging port 3*a* can be connected to the crank chamber 1*a* during the intake stroke. For this reason, even though the length of the piston 7 in an axial direction remains long, the scavenging port 3*a* can be connected to the crank chamber 1*a* through the notch 7*b*. Further, each notch 7*b* is positioned in the direction at 90 degrees relative to a direction in which the connection rod 6 swings, therefore enabling to control a so-called swinging movement of the piston 7.

Furthermore, in order to replace the fluid mixture in the vicinity of the scavenging port 3*a* with air, for example, it is necessary to provide the air flow passage 2 at a position near the scavenging port 3*a* of the scavenging flow passage 3 in the prior art, but in this embodiment of the present invention, the position is not limited. Therefore, it is possible to arrange a connection portion of the air flow passage 2 and the scavenging flow passage 3 and the check-valve 10 at any relative position. Specifically, flexibility in design can be increased. Accordingly, in terms of cooling ability and compactness, for example, optimum design can be made.

Upon forming the scavenging flow passage 3, the communication portion 30 and the scavenging direction adjustment portion 31 are inevitably necessary. Specifically, in the embodiment in which the cylinder chamber 4*a* and the crank chamber 1*a* are disposed up and down, it is necessary to extend the communication portion 30 in a vertical direction, and to form the scavenging direction adjustment portion 31 so as to face the cylinder inner face 4*b* by bending it almost at a right angle relative to the communication portion 30.

For this reason, in an area surrounded by the communication portion 30, the scavenging direction adjustment portion 31, and the cylinder inner surface 4*b,* a dead space with heavy wall thickness is formed. However, since the air flow passage 2 is formed in the dead space, the size of the engine is not increased at all as a result of providing the air flow passage 2. Consequently, it is not necessary to attach the air supply block 20 as shown in the prior art to the outside of the cylinder block 4, therefore enabling to be more compact in construction.

Further, since the communication portion 30 is provided with the check-valve 10, back-flow from the scavenging flow passage 3 to the air flow passage 2 can be prevented. The check-valve 10 is composed of a reed valve, therefore it does not hinder gas flow in the communication portion 30.

Furthermore, a part of the communication portion 30, the scavenging direction adjustment portion 31, a part of the cylinder inner surface 4*b,* and the air passage 2 are formed in a scavenging block 21 which is separate from the cylinder block 4, therefore the scavenging block 21 can be manufactured by die casting, for example, with facility. Specifically, it is difficult to form the cylinder block 4 having the communication portion 30, the scavenging direction adjustment portion 31, the air flow passage 2, and the like by die casting, but it is easy to form the scavenging block 21, which has the communication portion 30, the scavenging direction adjustment portion 31, the air flow passage 2, and the like, and is separate from the cylinder block 4, by die casting.

The aforesaid embodiment is configured in a manner that air flows from the scavenging flow passage 3 into the crank chamber 1*a* without passing through the scavenging port 3*a,* and also in a manner that air flows into the crank chamber 1*a* through the scavenging port 3*a,* but it may be configured in a manner that the air flowing therein without passing through the scavenging port 3*a* is stopped in front of the crank chamber 1*a*. In short, it may be suitable if at least the scavenging port 3*a* side in the scavenging flow passage 3 is filled with air. If the entire body of the scavenging flow passage 3 is filled with air, an advantage that the amount of air for scavenging increases is obtained.

In a state where the piston 7 reaches an upper-most position, the entire scavenging port 3*a* is opened, but it may be suitable if at least a part of the scavenging port 3*a* is opened, avoiding the side wall of the piston 7.

Further, the scavenging block 21 is configured so as to have the air flow passage 2 and the check-valve 10, but it may be suitable if it is configured without having the air flow passage 2 nor the check-valve 10. Specifically, in a normal two-cycle engine without including a stratified scavenging mechanism, it may be suitable to construct the similar scavenging flow passage with the scavenging block having the same function.

Furthermore, the scavenging direction adjustment portion 31 is formed so as to intersect the cylinder inner surface 4*b* at right angles, but the scavenging direction adjustment portion 31 may be formed so as to extend in various directions relative to the cylinder inner surface 4*b*.

INDUSTRIAL AVAILABILITY

The present invention is useful as a stratified scavenging two-cycle engine, which is more compact in construction.

What is claimed is:

1. A stratified, scavenging, two-cycle engine having a cylinder chamber and a crank chamber, the engine comprising:

a first passage extending between the cylinder chamber and the crank chamber; and an air flow passage to introduce air to the first passage, wherein the air flow passage extends into an area of the engine substantially surrounded by the first passage.

2. An engine in accordance with claim 1, wherein the area of the engine is surrounded by the first passage and an interior surface of the cylinder chamber.

3. An engine in accordance with claim 1, wherein the air flow passage is connected to the first passage through an air port.

4. An engine in accordance with claim 1, wherein the first passage includes a valve to prevent fluid flow from the first passage to the air flow passage.

5. A stratified, scavenging, two-cycle engine having a cylinder chamber and a crank chamber, the engine comprising:

a scavenging flow passage connected between the cylinder chamber and the crank chamber, the scavenging flow passage including a communication portion and a direction adjustment portion; and an air flow passage in fluid communication with the scavenging flow passage, wherein the communication portion of the scavenging flow passage originates at the crank chamber and extends for a length of the scavenging flow passage, and the direction adjustment portion extends from the communication portion of the scavenging flow passage to a scavenging port that opens into the cylinder chamber, and wherein the air flow passage extends into an area of the engine substantially surrounded by the scavenging flow passage.

6. An engine in accordance with claim 5, wherein the area of the engine is surrounded by the scavenging flow passage and an interior surface of the cylinder chamber.

7. An engine in accordance with claim 6, wherein the air flow passage is connected to the scavenging flow passage through an air port.

8. An engine in accordance with claim 7, wherein the engine includes a scavenging block, wherein the scavenging block includes at least a portion of the communication portion of the scavenging passage, at least a portion of the direction adjustment portion of the scavenging passage, at least a portion of the cylinder chamber, and the air port.

9. An engine in accordance with claim 5, wherein the scavenging flow passage includes a valve to prevent fluid flow from the scavenging flow passage to the air flow passage.

10. An engine in accordance with claim 5, wherein the engine includes a scavenging block, wherein the scavenging block includes at least a portion of the communication portion of the scavenging passage, the direction adjustment portion of the scavenging passage, and at least a portion of the cylinder chamber.

11. A stratified, scavenging, two-cycle engine comprising:

a cylinder head;

a crankcase having a crankshaft within a crank chamber;

a piston coupled to the crankshaft; and a scavenging block, interpositioned between the cylinder head and the crankcase, substantially defining a cylinder chamber to receive the piston, wherein the crankcase and scavenging block cooperate to provide:

a scavenging flow passage connected between the cylinder chamber and the crank chamber, the scavenging flow passage including a communication portion and a direction adjustment portion; and an air flow passage in fluid communication with the scavenging flow passage, wherein the communication portion of the scavenging flow passage originates at the crank chamber and extends for a length of the scavenging flow passage, and the direction adjustment portion extends from the communication portion of the scavenging flow passage to a scavenging port that opens into the cylinder chamber, and wherein the air flow passage extends into an area of the engine substantially surrounded by the scavenging flow passage.

12. An engine in accordance with claim 11, wherein the area of the engine is surrounded by the scavenging flow passage and an interior surface of the cylinder chamber.

13. An engine in accordance with claim 12, wherein the air flow passage is connected to the scavenging flow passage through an air port.

14. An engine in accordance with claim 11, wherein the scavenging flow passage includes a valve to prevent fluid flow from the scavenging flow passage to the air flow passage.

* * * * *